US005313901A

United States Patent [19]

Fujii

[11] Patent Number: 5,313,901

[45] Date of Patent: May 24, 1994

[54] FEED DEVICE FOR SEWING MACHINE

[75] Inventor: Hisao Fujii, Toyonaka, Japan

[73] Assignee: Yamato Mishin Seizo Kabushiki Kaisha, Osaka, Japan

[21] Appl. No.: 7,083

[22] Filed: Jan. 21, 1993

[30] Foreign Application Priority Data

Mar. 23, 1992 [JP] Japan ..... 4-024474[U]

[51] Int. Cl.[5] ..... D05B 27/04

[52] U.S. Cl. ..... 112/320; 112/314

[58] Field of Search ..... 112/311, 320, 303, 312, 112/313, 314, 235

[56] References Cited

U.S. PATENT DOCUMENTS 5,113,773 5/1992 Klundt ..... 112/320

5,138,962 8/1992 Klundt ..... 112/320 X

*Primary Examiner*—Clifford D. Crowder

*Assistant Examiner*—Paul C. Lewis

*Attorney, Agent, or Firm*—Wolf, Greenfield & Sacks

[57] ABSTRACT

A feed device for a sewing machine incorporates an upper feed dog above a throat plate and a lower feed dog below the throat plate and conveys material fabrics to a needle drop point by way of sandwiching the material fabrics between the upper and lower feed dogs. The feed device incorporates an energizing member for energizing the upper feed dog in the direction of the throat plate and controls the sandwiching force between the upper and lower feed dogs by constraining the energizing force generated by the energizing member.

18 Claims, 4 Drawing Sheets

FEED DEVICE FOR SEWING MACHINE

BACKGROUND OF THE INVENTION

1. Field of the Invention

The present invention relates to a feed device for a sewing machine. The feeding device related to the invention incorporates an upper feed dog which executes fabric-feeding operations above a throat plate in association with a lower feed dog installed below the throat plate to enable the upper and lower feed dogs to properly deliver feeding force onto and below material fabrics so that material fabrics can smoothly be delivered to a needle drop point. In particular, the invention relates to the upper feed dog provided for the feed device.

2. Description of the Related Art

Conventionally, delivery of material fabrics is executed by exerting feeding force to material fabrics inserted between a presser foot provided for a sewing machine extending to the front and the back of the needle drop point and a throat plate provided for a bed, by the use of a lower feed dog installed below the throat plate. Using a conventional feed device, the lower feed dog performs predetermined feeding operations in association with the operation of the sewing machine. Concretely, the lower feed dog performs elliptic movement in substantially vertical surface along the feeding direction. The lower feed dog projects itself above the throat plate at the upper domain of the locus of the elliptic movement. Simultaneous with the projecting movement of the lower feed dog, material fabrics are sandwiched between the lower feed dog and the bottom surface of the presser foot.

Nevertheless, when operating the conventional feed device cited above, the lower feed dog exerts its feed force only to the bottom of material fabrics. In consequence, when, for example, plural material fabrics are sewn together, a gap is easily generated between the bottom fabric receiving the feed force and the top fabric slipping itself along the presser foot. Therefore, in order to securely yield quality goods from a sewing operation without incurring sewing slippage at all, operator of any conventional sewing machine needs to manually perform delicate adjustment of fabric feeding mechanism in front of the feed device.

When operating any of above mentioned sewing machines like an interlock chainstitch sewing machine, or a one-needle double chainstitch sewing machine, or a multi-needle double chainstitch sewing machine for example, in addition to a proper lower feed dog provided below the throat plate, an upper feed apparatus may be provided. The upper feed apparatus is of such a structure having an upper feed dog which is disposed above the throat plate in front of the needle drop point in order that fabric-feeding operation identical to that is performed by the lower feed dog can be executed in association with this lower feed dog. Material fabric transferred onto the throat plate is sandwiched between the upper and lower feed dogs before affecting feed force to the top and bottom surfaces of the sandwiched fabric.

Concretely, the conventional upper feed apparatus has an operating rod which is set to a predetermined position close to the needle drop point by way of projecting itself in the downward direction from the interior of the sewing machine and a feed body which is secured to the tip domain of the operating rod. The upper feed dog is provided at an end of the feed body which extends itself to the front of the needle drop point by way of facing the top surface of the throat plate. The operating rod is connected to the drive unit of the sewing machine via predetermined transmission mechanism. The operating rod swings itself back and forth in the feeding direction simultaneously with its linear movement being performed in the vertical direction in association with mechanical operation of the sewing machine.

In correspondence with those movements performed by the operating rod, the upper feed dog executes elliptic movements in association with the mechanical operation of the sewing machine and in synchronization with the operation of the lower feed dog installed below the throat plate. While the upper feed dog moves downward, it closely approaches the lower feed dog which moves upward, and then, both the upper and lower feed dogs conjunctionally shift themselves to the rear domain of the feeding direction. As a result, a pair of material fabrics transferred onto the throat plate are tightly inserted between the upper and lower feed dogs before eventually being delivered to the needle drop point by effect of feed force transmitted from the upper and lower feed dogs, thus enabling sewing operators to solve those technical problems cited earlier.

When operating any conventional sewing machine incorporating such an upper feed apparatus based on the structure described above, in order to generate an adequate amount of feed force between the upper and lower feed dogs, fixing position of the feed body of the operating rod is variable. This in turn permits adjustment of clearance between the upper and lower feed dogs being close to each other. In other words, initial adjustment of the feed gap is performed for the material fabrics in proportion to the thickness of the inserted material fabrics before eventually starting off the sewing operation.

Nevertheless, when operating any of those conventional sewing machines requiring provision of the upper feed dog like an interlock chainstitch sewing machine or a one-needle double chainstitch sewing machine for example, in particular, when changing condition of double fabrics or folding condition of these material fabrics on the way of sewing operation, an operator often performs such an operation in order that the thickness of those material fabrics can continuously be varied or on the stepwise basis. In this case, when a sewing operation is executed against thicker domain of the material fabrics, these material fabrics are tightly inserted between the upper and lower feed dogs, thus easily incurring damage to the material fabrics. Conversely, when a sewing operation is executed against those relatively thin domains of those material fabrics, the upper feed dog remains inoperative to merely result in the insufficient feed force, thus unavoidable generating sewing slippage. In consequence, quality goods cannot securely be yielded from a sewing machine provided with the conventional feed device.

SUMMARY OF THE INVENTION

Therefore, an object of the invention is to provide a novel feed device for a sewing machine which can precisely follow up variable thickness of objective material fabrics and stably provide objective material fabrics with an adequate amount of feed force.

Another object of the invention is to provide a novel feed device for a sewing machine which can securely prevent occurrence of those disadvantageous factors causing degradation of the quality of sewn-up fabrics like sewing slippage or damage incurring to objective material fabrics and enables a sewing operator to stably yield quality goods from the sewing operation.

The novel feed device for a sewing machine according to the invention is provided with an upper feed dog above a throat plate and a lower feed dog below the throat plate so that these feed dogs can properly sandwich material fabrics before conveying these fabrics to a needle drop point. Characteristically, the novel feed device incorporates energizing means for energizing the upper feed dog in the direction of the throat plate and adjustment means for controlling the energizing force of the energizing means and properly adjusting pressure for sandwiching the objective material fabrics between the upper and lower feed dogs.

A feed body equipped with the upper feed dog is provided. However, the feed body is not directly secured to an operating rod interlinked with the operation of the sewing machine, but instead, the feed body is swingably held by a feed dog holder which pivots on its horizontal axis. The upper feed dog provided for the feed body is energized in the direction of the throat plate by means of the energizing means like a coil spring inserted between the feed dog holder and the feed body. The novel feed device precisely follows up the variation of the thickness of material fabrics by effect of vertical movement of the upper feed dog generated with the swing of the feed body and against the energizing force from the coil spring functioning as the energizing means. To feature the invention, the novel feed device incorporates the adjustment means for properly adjusting the energizing force generated by the energizing means by properly adjusting initial length of the coil spring. In this way, the adjustment means is properly controlled in correspondence with mean thickness of the material fabrics so that the feed device can precisely follow up variable thickness of these material fabrics on the throat plate by varying the range of vertical movement performed by the upper feed dog.

The above and further objects and features to the invention will more fully be apparent from the following detailed description with accompanying drawings.

DESCRIPTION OF THE PREFERRED EMBODIMENTS

Referring now more particularly to the accompanying drawings, detailed aspects of the feed device for a sewing machine according to an embodiment of the invention are described below.

Figure 1:
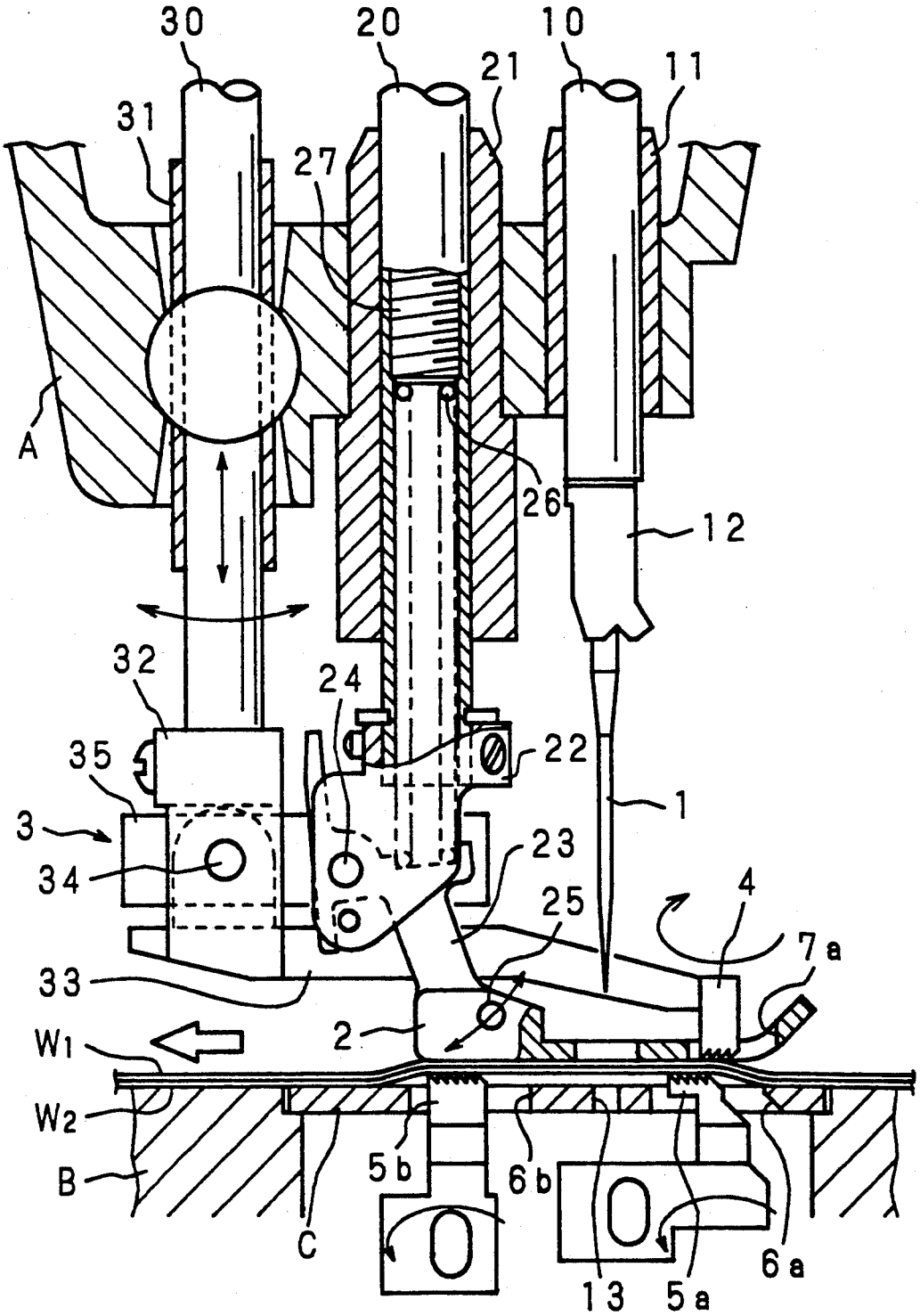
FIG. 1 is a lateral sectional view of mechanical components adjoining the needle drop point by way of illustrating the state in which feed force is transmitted to material fabrics inserted in a sewing machine incorporating the feed device embodied by the invention.
Figure 2:
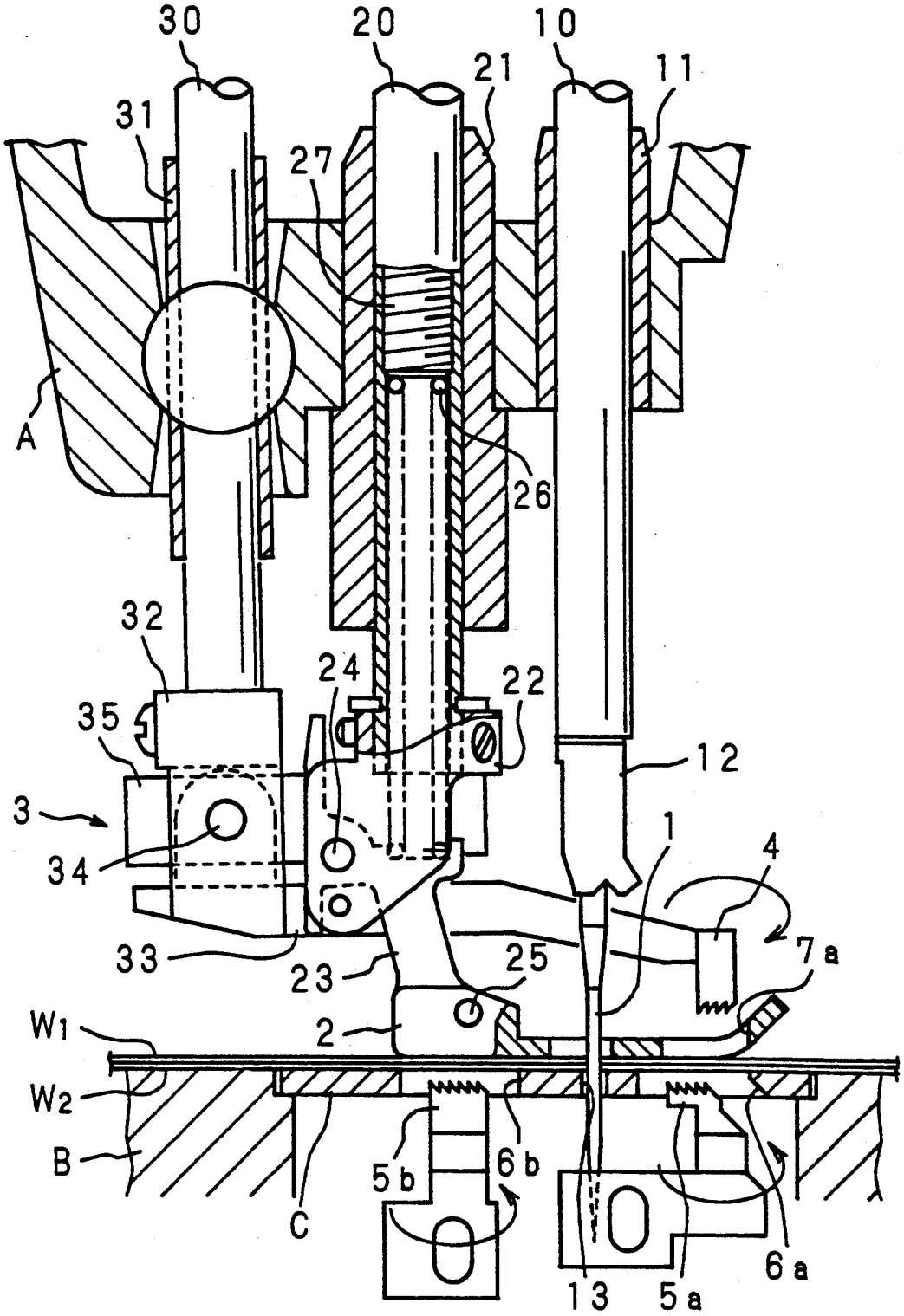
FIG. 2 is a lateral section view of mechanical components adjoining the needle drop point by way of illustrating the state in which no feed force is transmitted to material fabrics inserted in the sewing machine incorporating the feed device embodied by the invention.

FIGS. 1 and 2 respectively illustrate lateral sectional views of mechanical components adjoining the needle drop point of a sewing machine incorporating the feed device embodied by the invention. The reference character A designates a main body of the sewing machine, whereas the reference character B designates a bed. A throat plate C is secured to the top surface of the bed B which is installed below the main body A of the sewing machine. Using the sewing machine, sewing operation is executed against material fabrics fed along the upper surface of the throat plate C from right to left in FIGS. 1 and 2. Both FIG. 1 and 2 show the state in which mutually layered material fabrics W1 and W2 are sewn together. FIG. 1 illustrates the state in which feed force is transmitted to those material fabrics W1 and W2, whereas FIG. 2 illustrates the state in which no feed force is transmitted to those material fabrics W1 and W2.

A needle bar 10, a presser rod 20, and a feed rod 30 vertically extend themselves in the direction of the throat plate C, where these rod 10, 20 and 30 are aligned in parallel with each other in the front and on the back of the path for conveying those material fabrics W1 and W2. Of these, the needle bar 10 in the front of the fabric conveying path is held by a bush 11 secured to the main body A of the sewing machine by way of freely sliding itself in the vertical direction. A needle 1 is secured to the bottom tip end of the needle bar 10 via a stopper member 12. The needle 1 moves itself in the vertical direction in response to the drive force transmitted from a main shaft (not shown) accommodated in the main body A of the sewing machine.

A needle hole 13 penetrating the throat plate C in the direction of the thickness of the throat plate C is formed right below the needle 1. In association with the vertical movement of the needle bar 10, the bottom tip of the needle 1 reciprocates itself in the vertical direction between the upper position shown in FIG. 1 above the throat plate C and the bottom position shown in FIG. 2 which illustrates the state in which the bottom tip of the needle 1 has fully arrived at the bottom domain of the throat plate C after vertically penetrating the needle hole 13. While following up reciprocation in the vertical direction, the needle 1 executes sewing operation by piercing through those material fabrics W1 and W2 on the throat plate C.

The presser rod 20 behind the needle bar 10 is held by a bush 21 secured to the main body A of the sewing machine so that the presser rod 20 can freely slide itself in the vertical direction. A presser foot 2 is secured to the bottom end of the presser rod 20 via a feed dog holder 22 and a presser arm 23. The feed dog holder 22 is secured to the bottom and of the presser rod 20 with a screw. The top end of the presser arm 23 is held at a predetermined position behind the axis of the feed dog holder 22 so that the presser arm 23 can freely swing itself in the periphery of the horizontal shaft via a hinge pin 24. On the other hand, the presser foot 2 is held below the bottom surface of the presser arm 23 via a hinge pin 25 which is set to a predetermined position below and in front of the hinge pin 24 by way of freely swinging itself in the periphery of the horizontal axis via the hinge pin 25.

As is clear from the partially exposed sectional views shown in FIGS. 1 and 2, the presser rod 20 is of hollow structure which internally accommodates a presser spring 26. The top end of the presser spring 26 is held in contact with the bottom end of a stopper screw 27 coupled with the pressure rod 20, whereas the bottom end of the presser spring 26 is held in contact with the top end of the presser arm 23 on the axis of the pressure rod 20.

The presser foot 2 is constantly energized in the downward direction by the force generated by the presser spring 26 and pressed against the throat plate C. After delivering material fabrics W1 and W2 to the top surface of the throat plate C, when upward force is exerted in resistance against spring force via those material fabrics W1 and W2, the presser foot 2 swings itself in conjunction with the presser arm 23 in the periphery of the hinge pin 24 to securely sandwich those material fabrics W1 and W2 between the bottom surface of the presser foot 2 and the top surface of the throat plate C. While this condition is present, availing of its swinging movement around the hinge pin 25, the presser foot 2 can vary its angle against the presser arm 23. As shown in FIGS. 1 and 2, the presser foot 2 constantly sandwiches those material fabrics W1 and W2 between its bottom surface and the top surface of the throat plate C.

The top end of a stopper screw 27 coupled with the presser rod 20 extends to an upper domain of the main body A of the sewing machine. The bottom position of the stopper screw 27 in contact with the presser spring 26 can be shifted by operating an adjustment knob (not shown) which is set to the extended end of the stopper screw 27. In addition, the force generated by the presser spring 26 for energizing the presser foot 2 via the presser arm 23 can be varied by operating this adjustment knob. In other words, pressing force of the presser foot 2 against those material fabrics W1 and W2 can properly be varied by operating the adjustment knob in correspondence with the thickness and kind of material of those material fabrics W1 and W2.

In particular, in the event that there is stepwise or continuous variation of the thickness of those material fabrics W1 and W2, for example, whenever changing the superposed condition or the folded condition of those material fabrics on the way of executing sewing operation, the variation of the thickness of those material fabrics is effectively absorbed by the swinging movement of the presser foot 2 generated in the periphery of the hinge pin 24 in resistance against the force energized by the presser spring 26. The excessive variation in the thickness of those material fabrics on the throat plate C beyond the absorptive potential available from the swinging movement of the presser foot 2 can effectively be absorbed by effect of vertical movement of the presser rod 20 generated along the bush 21. In consequence, the presser foot 2 can maintain satisfactory pressing state.

Absorption of varied thickness of those material fabrics W1 and W2 is mainly effected by the swinging movement of the presser arm 23 and the presser foot 2 generated in the periphery of the hinge pin 24, in other words, varied thickness of those material fabrics W1 and W2 is absorbed by the swinging movement of a domain having low inertia below the hinge pin 24, and therefore, swinging movement of the presser arm 23 and the presser foot 2 effectively absorbs frequent variation of the thickness of those material fabrics occurring in the sewing operation. As mentioned earlier, the hinge pin 25 supporting the presser foot 2 is set to a predetermine position in front of and below the hinge pin 24 which itself makes up the pivot of the swinging movement performed by the presser foot 2. As shown in FIG. 1 by means of arrowed direction, swinging movement of the presser foot 2 is generated in the oblique direction against the direction of conveying those material fabrics W1 and W2. As a result, absorption of the varied thickness of those material fabrics is smoothly effected without incurring obstruction to the conveying operation of those material fabrics w1 and W2.

The feed rod 30 behind the presser rod 20 is inserted through a bush 31 which swings itself back and forth. The center domain of the feed rod 30 is supported by the main body A of the sewing machine, where the feed rod 30 is coupled with the bush 31 by way of freely sliding itself in the lengthwise direction. The top end of the feed rod 30 is connected to a main shaft (not shown) inside of the main body A of the sewing machine via a conventional transmission unit. As shown in FIG. 1 by means of arrowed direction, relative to the rotation of the main shaft inside of the main body A of the sewing machine, the feed rod 30 swings itself back and forth in conjunction with the bush 31 synchronous with its linear movement in the direction of the length of the bush 31. In association with these movements, including the axis of the feed rod 30, elliptic movement is generated at the bottom end of the feed rod 30 within specific surface in the direction of conveying those material fabrics W1 and W2.

The upper feed apparatus 3 has the following; the feed rod 30 serving itself as an operating rod which executes those functional operations just mentioned above, a feed dog holder 32 which is secured to the bottom end of the feed rod 30 with a screw, and a feed body 33 which is secured to a side of the feed dog holder 32. As shown in FIGS. 1 and 2, the feed body 33 has a lengthy plate member. Rear domain of the feed body 33 is supported by a hinge pin 34 which is horizontally inserted in the feed dog holder 32. The feed body 33 extends itself in the forward direction by way of passing by lateral domains of the presser foot 2 and the needle 1. The saw-toothed upper feed dog 4 is set to the external front end of the feed body 33 by way of facing the top surface of the throat plate C at a position farther than the needle 1.

Figure 3:
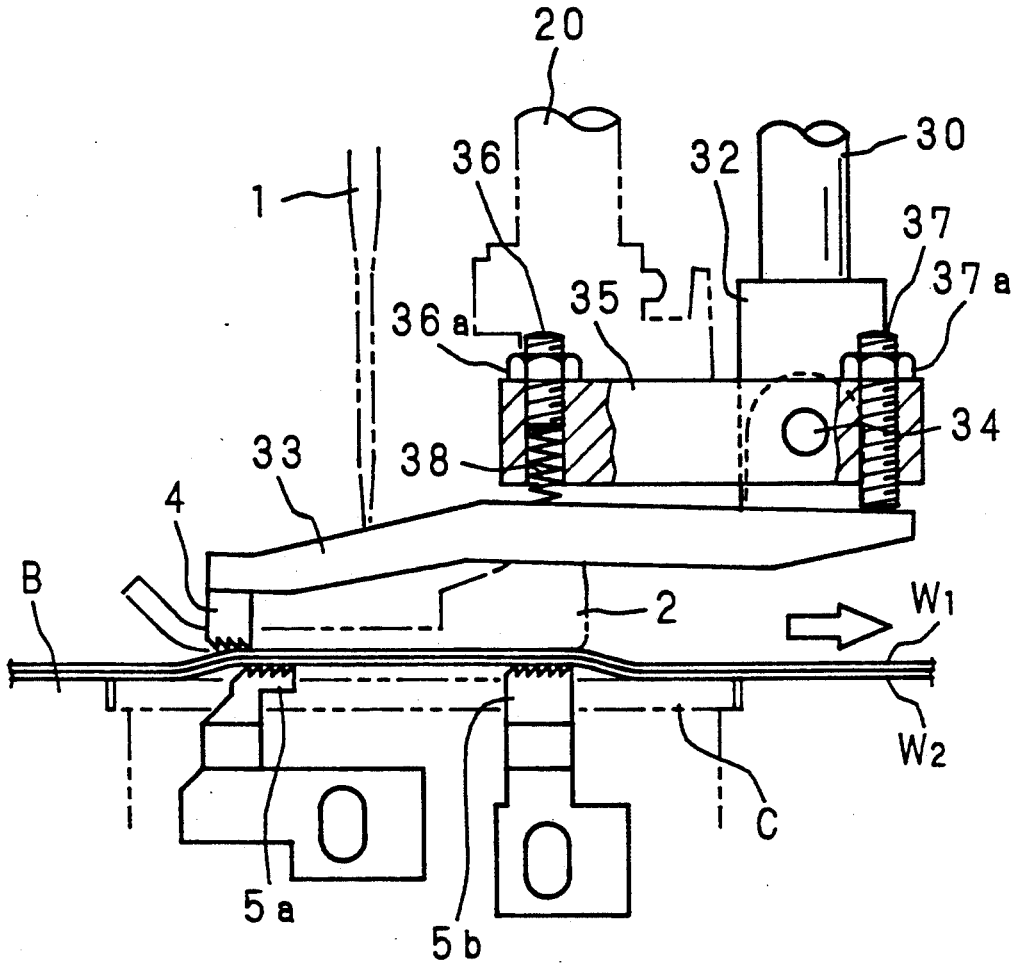
FIG. 3 is a partially exposed lateral view of the upper feed apparatus embodied by the invention by way of illustrating the state in which feed force is transmitted to material fabrics inserted in the sewing machine related to the invention.
Figure 4:
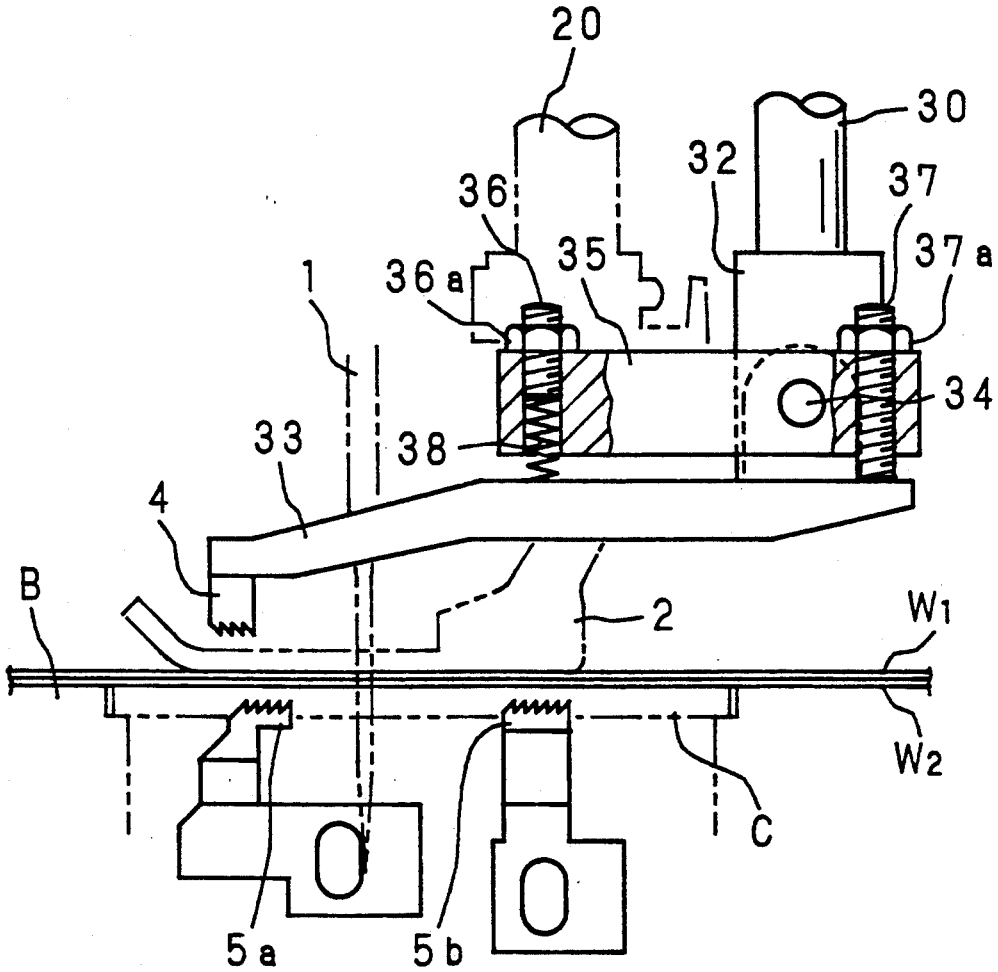
FIG. 4 is a partially exposed lateral view of the upper feed apparatus embodied by the invention by way of illustrating the state in which no feed force is transmitted to material fabrics inserted in the sewing machine related to the invention.

FIGS. 3 and 4 are respectively partially exposed lateral views of the upper feed apparatus 3 as seen from the opposite side of the structure shown in FIGS. 1 and 2. As shown in FIGS. 3 and 4, a presser bracket 35 is secured to the top surface of the feed body 33 which is secured to the feed dog holder 32, where the presser bracket 35 above the feed body 33 is provided in the extended direction of the feed body 33. A pair of screw holes are provided on the forward and backward sides of the presser bracket 35 by way of penetrating it in the vertical direction. A spring pressing screw 36 is coupled with the front screw hole, whereas a stopper screw 37 is coupled with the rear screw hole.

The spring pressing screw 36 is inserted in the front screw hole until the tip of the screw 36 reaches the halfway of the receptive screw hole. The spring pressing screw 36 can properly be fixed by fastening a lock nut 36*a* which is coupled with a projected part on the top surface of the presser bracket 35. A coil spring 38 functioning itself as energizing means is secured between the bottom end of the spring pressing screw 36 and a position on the top surface of the feed body 33 in front of the feed-body fixing domain held by the hinge pin 34. On the other hand, the stopper screw 37 is inserted in the rear screw hole until the tip of the screw 37 projects itself below the receptive screw hole. The stopper screw 37 can properly be fixed by fastening a lock nut 37*a* which is coupled with a projected part on the top surface of the presser bracket 35. The bottom end of the stopper screw 37 faces the top surface of the feed body 33 at a position behind the feed-body fixing domain held by the hinge pin 34.

The feed body 33 built in the structure mentioned above is provided with the upper feed dog 4 below the front end. The force generated by the coil spring 38 energizes the front end of the feed body 33 downward in the direction of the throat plate C. In consequence, as shown in FIG. 4, swinging movement performed in the periphery of the hinge pin 34 caused by the energizing force from the coil spring 38 is constrained by the feed body 33 in contact with the tip end of the stopper screws 37 behind the hinge pin 34. In association with the movement of the bottom end of the feed rod 30 mentioned above, the upper feed dog 4 below the front end of the feed body 33 performs elliptic movement in the arrowed direction shown in FIGS. 1 and 2.

On the other hand, a pair of lower feed dogs 5*a* and 5*b* are provided in the front and rear positions inside of the bed B of the sewing machine below the throat plate C. The lower feed dog 5*a* in the front position faces the upper feed dog 4 via a feed slot 6*a* formed at a position corresponding to the throat plate C and another feed slot 7*a* formed in front of the presser foot 2. The lower feed dog 5*b* in the rear position faces the rear bottom surface of the presser foot 2 via a feed slot 6*a* formed at a position corresponding to the throat plate C. These lower feed dogs 5*a* and 5*b* are respectively linked with the main shaft of the main body A of the sewing machine via a conventional transmission unit inside of the bed B. These lower feed dogs 5*a* and 5*b* respectively perform elliptic movement within the surface orthogonally intersecting the throat plate C along the direction of conveying those material fabrics W1 and W2.

These lower feed dogs 5*a* and 5*b* respectively perform elliptic movement in correspondence with the vertical movement of the needle 1. Concretely, while the tip of the needle 1 is above the throat plate C, as shown in FIG. 1, these lower feed dogs 5*a* and 5*b* respectively project themselves above the throat plate C to push the presser foot 2 upward, and simultaneously, those lower feed dogs 5*a* and 5*b* shift themselves backward along those feed slots 6*a* and 6*b* to deliver moving force to those material fabrics W1 and W2 inserted between those lower feed dogs 5*a* and 5*b* and the presser foot 2. Conversely, while those material fabrics W1 and W2 are integrally sewn together by the tip of the needle 1 that has already arrived at a predetermined depth position below the throat plate C, as shown in FIG. 2, those lower feed dogs 5*a* and 5*b* retreat themselves below the throat plate C, and then move themselves in the forward direction.

While these sequential operations are underway, the upper fed dog 4 in opposition from the lower feed dog 5*a* performs its movement based on a phase inverse from that of the other lower feed dog 5*b*. Concretely, while the tip of the needle 1 is above the throat plate C, as shown in FIG. 1, the upper feed dog 4 approaches the throat plate C, and then executes a feeding operation by way of shifting itself backward along the feed slot 7*a* formed in front of the presser foot 2. Conversely, while those material fabrics W1 and W2 are integrally sewn together by the tip of the needle 1 that has already arrived below the throat plate C, as shown in FIG. 2, the upper feed dog 4 is apart from the top surface of the throat plate C by proper height in order to shift itself in the forward direction.

As shown in FIG. 1, the upper feed dog 4 engaged in the feeding operation is pressed downward by those material fabrics W1 and W2 below the presser foot 2. The upper feed dog 4 moving force to those material fabrics W1 and W2 by sandwiching them with the lower feed dog 5*a*. As a result, these material fabrics W1 and W2 are delivered to the needle drop point by effect of the moving force transmitted to the top and bottom surface of these material fabrics without generating slippage at all.

FIG. 3 illustrates the state of the upper feed apparatus 3 while being engaged in a feeding operation. While the upper feed dog 4 exerts a depressive operation, the feed body 33 which is equipped with the upper feed dog 4 at the front end swings itself in the periphery of the hinge pin 34 in resistance against the energizing force from the coil spring 38, and then, the rear end of the feed body 33 slightly leaves the tip of the stopper screw 37 as shown in FIG. 3. Concretely, in the upper feed apparatus 3, since the magnitude of pressing force exerted by the upper feed dog 4 can freely be set by optionally adjusting the energizing force generated by the coil spring 38, in other words, since the magnitude of the pressing force exerted by the upper feed dog 4 can freely be determined by properly adjusting the screwing length of the spring pressing screw 36 or the stopper screw 37, the upper feed apparatus 3 can constantly feed stable feeding force in the course of a sewing operation. The spring pressing screw 36 serves as an adjustment means for adjusting the magnitude of the energizing force acting on the upper feed dog independently of the height of the upper feed dog.

Even after setting energizing force of the coil spring 38, availing of swinging movement generated by the feed body 33 in association with the contraction of the coil spring 38, the upper feed dog 4 can securely move itself in the vertical direction within a predetermined range. Therefore, even though the thickness of those material fabrics W1 and W2 is variable in a sewing operation, the feed device embodied by the invention precisely follows up the variable thickness of these material fabrics. In consequence, the upper feed dog 4 can exert satisfactory effect of depressing those material fabrics W1 and W2, thus enabling the sewing system to stably yield quality goods from sewing operations without generating defective domains otherwise caused by sewing slippage or damage incurred to those material fabrics.

The above description of the embodiment of the invention has merely referred to the introduction of the coil spring 38 as means for energizing the upper feed dog 4. Nevertheless, the embodiment of the invention also permits introduction of any practical energizing means other than the coil spring 38 like a plate spring inserted between the feed dog holder 32 and the feed body 33 or any elastic material like rubber inserted between these components as well.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An upper feed apparatus for a sewing machine, comprising:

an upper feed dog for executing an operation for feeding material fabrics;

energizing means for generating an energizing force acting on said upper feed dog in the direction of the material fabrics; and adjustment means for adjusting the magnitude of the energizing force acting on said upper feed dog independently of the height of the upper feed dog.

2. An upper feed apparatus for a sewing machine as set forth in claim 1, wherein said adjustment means adjusts the energizing force in correspondence with the thickness of the material fabrics.

3. An upper feed apparatus for a sewing machine as set forth in claim 1, wherein said energizing means includes a coil spring.

4. An upper feed apparatus for a sewing machine as set forth in claim 1, further comprising displacement means for vertically displacing the upper feed dog in conjunction with a variation in thickness of the material fabrics.

5. An upper feed apparatus for a sewing machine as set forth in claim 4, wherein the displacement means comprises a spring.

6. An upper feed apparatus for a sewing machine as set forth in claim 4, wherein said adjustment means comprises at least one screw.

7. An upper feed apparatus for a sewing machine, comprising:

an operating rod;

a feed body which is held by said operating rod;

an upper feed dog connected to said feed body, wherein said upper feed dog executes an operation for feeding material fabrics;

a bracket which is secured to said operating rod;

a pair of screws which are respectively coupled with said bracket; and a coil spring which is inserted between one of said pair of screws and said feed body and energizes said upper feed dog in the direction of the material fabrics;

wherein the energizing force generated by said coil spring is controlled by adjusting the screwing length of at least one of said pairs of screws.

8. A feed device for a sewing machine for feeding material fabrics to a needle drop point, comprising:

a lower feed dog which is provided below a throat plate;

an upper feed dog which is provided above the throat plate;

energizing means for generating an energizing force acting on said upper feed dog in the direction of the throat plate; and adjustment means for adjusting the magnitude of the sandwiching force between said upper and lower feed dogs by controlling the energizing force acting on said upper feed dog independently of the height of the upper feed dog.

9. A feed device for a sewing machine as set forth in claim 8, further comprising;

means for interlinking the feeding operation of said lower feed dog with the feeding operation of said upper feed dog.

10. A feed device for a sewing machine as set forth in claim 8, wherein said adjustment means adjusts the sandwiching force in correspondence with the thickness of the material fabrics.

11. A feed device for a sewing machine as set forth in claim 8, wherein said energizing means includes a coil spring.

12. A feed device for a sewing machine as set forth in claim 8, wherein said upper feed dog is positioned in front of the needle drop point.

13. A feed device for a sewing machine as set forth in claim 8, further comprising displacement means for vertically displacing the upper feed dog in conjunction with a variation in thickness of the material fabrics.

14. A feed device for a sewing machine as set forth in claim 13, wherein the displacement means comprises a spring.

15. A feed device for a sewing machine as set forth in claim 13, wherein said adjustment means comprises at least one screw.

16. An upper feed apparatus for a sewing machine, comprising:

an operating rod;

an upper feed member pivotably mounted on said operating rod, wherein said upper feed member executes an operation for feeding material fabrics;

a bracket which is secured to said operating rod;

a pair of screws which are respectively coupled with said bracket; and adjustable energizing means, inserted between one of said pair of screws and said upper feed member, for energizing said upper feed member in the direction of the material fabrics.

17. An upper feed apparatus for a sewing machine as set forth in claim 16, wherein the upper feed member has a material contact end which contacts the material fabrics during the operation for feeding material fabrics, a non-contact end opposite the material contact end, and a pivot point between the material contact end and the non-contact end where the upper feed member is pivotably mounted to said operating rod; and wherein one of said pair of screws is positioned between the material contact end and the pivot point, and the other of said pair of screws is positioned between the non-contact end and the pivot point.

18. An upper feed apparatus for a sewing machine as set forth in claim 17, wherein the adjustable energizing means comprises a coil spring.

* * * * *